United States Patent [19]

Lumme

[11] 4,029,919

[45] June 14, 1977

[54] LOCKING ARRANGEMENT WITH BURGLAR ALARM

[75] Inventor: Edgar Lumme, Telgte, Westflaen, Germany

[73] Assignee: Aug. Winkhaus, Telgte, Germany

[22] Filed: Jan. 21, 1976

[21] Appl. No.: 650,934

[52] U.S. Cl. ..... 200/52 R; 70/DIG. 49; 200/61.66; 340/274 R

[51] Int. Cl.[2] ..... H01H 35/00

[58] Field of Search ..... 200/42 R, 44, 52 R, 200/61.66, 61.64; 340/274 R; 70/DIG. 49; 109/44

[56] References Cited

UNITED STATES PATENTS 3,587,080 6/1971 Hawkins ..... 340/274

*Primary Examiner*—Thomas J. Kozma
*Attorney, Agent, or Firm*—Hans Berman

[57] ABSTRACT

A cylinder lock is provided with a contact carrier for the movable contact of a switch in an electrically operated burglar alarm. A spring mounted on the contact carrier and radially projecting from the casing of the lock is stressed by engagement with the wall of the door aperture receiving the lock and biases the contact carrier toward a switch opening position. When it is attempted to pull the lock from the door, the spring pivots the contact carrier and the alarm is energized.

11 Claims, 13 Drawing Figures

LOCKING ARRANGEMENT WITH BURGLAR ALARM

This invention relates to locks combined with burglar alarms, and particularly to a locking arrangement in which an attempt to pull a cylinder lock from its normal position in a door or the like causes an electrically operated alarm to be energized.

A locking arrangement of the general type referred to above has been disclosed in the published German patent application No. 2,118,308. While the known device is effective, it is complex in its structure and correspondingly costly to build.

It is an important object of this invention to provide a locking arrangement capable of energizing a burglar alarm which is relatively simple and correspondingly inexpensive , yet provides good protection against attempts at tampering.

In one of its more specific aspects, the invention provides a locking arrangement in which a cylinder is mounted in a casing for angular movement about an axis and is formed with a key slot extending inward of one axially terminal face of the cylinder. A set of tumblers in the casing and cylinder normally prevents the angular movement while permitting such movement in response to insertion of a proper key in the key slot, as may be conventional in itself. A portion of a spring radially projects from the casing and is axially movable relative to the casing. The spring is stressed resiliently when its projecting portion is moved in one axial direction. Fixed and movable contacts are mounted on the casing in electrically insulated relationship. A motion transmitting contact carrier is interposed between the spring and the movable contact for biasing the latter toward a contact opening position remote from the fixed contact in response to the stressing of the spring while causing conductive engagement of the contacts in response to movement of the projecting portion in the other axial direction.

Other features, additional objects, and many of the attendant advantages of this invention will readily be appreciated as the same becomes better understood by reference to the following detailed description of preferred embodiments when considered in connection with the appended drawing in which.

Figure 1:
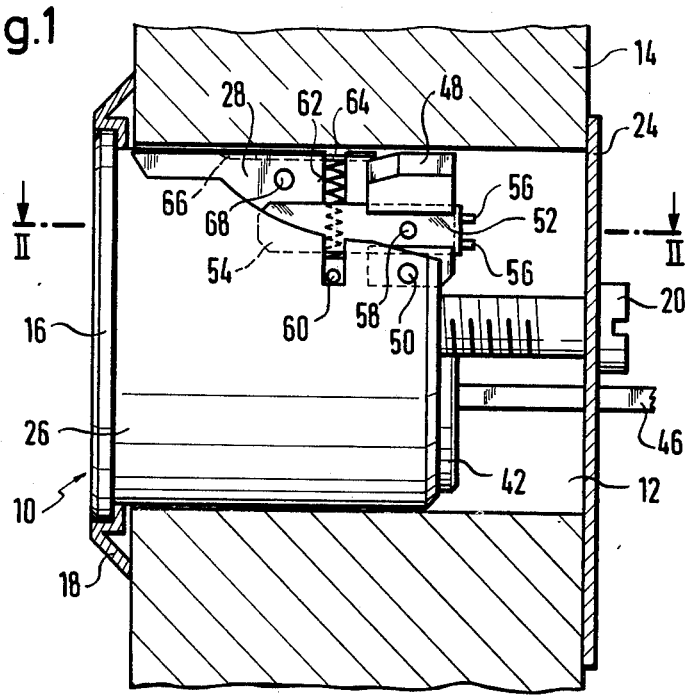
FIG. 1 shows a solid door equipped with a cylinder tion.

Referring now to the drawing in detail, and initially to FIG. 1, there is shown a cylinder lock 10 almost completely received in a cylindrical through-bore 12 of a supporting door 14 which is a plate-shaped, solid body of wood. A flange 16 on the casing 26 of the lock 10 abuttingly engages a frustoconical collar 18 about the orifice of the bore 12, thereby preventing movement of the lock inward of the bore 12 from the illustrated position. Two machine screws 20 are partly received in threaded bores 22 (FIG. 4) of the casing 26. The portions of the screws 22 projecting from the terminal rear face of the casing 26 carry heads which hold a steel plate 24 against the inner face of the door 14. The top portion 28 of the otherwise cylindrical casing 26 is formed with milled recesses as will presently be described.

Figure 3:
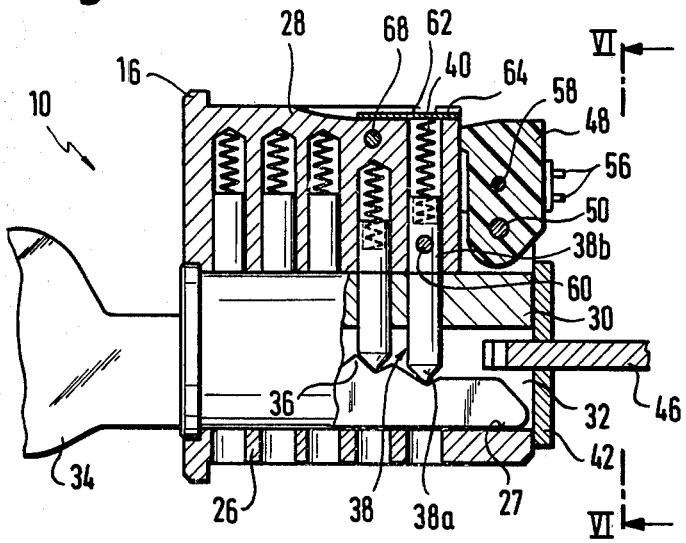
FIG. 3 is a sectional view of the cylinder lock taken on the line III—III in FIG. 2, and additionally illustrates an inserted key.

A cylindrical bore 27 in the lower casing portion rotatably receives a lock cylinder 30 formed with a key slot 32 which permits insertion of a key 34 through the terminal front face of the cylinder, as is shown in FIG. 3. Serrations 36 of the key 34 are engaged by five pairs of tumbler pins 38 received in radial bores of the casing 26 and the cylinder 30. After insertion of a proper key 34, the pins **38*a* in the cylinder 30 are radially aligned with the corresponding pins 38*b* in the casing 26 and are held in engagement with the serrations 36 by helical compression springs 40 in the bores of the casing 26. The abuttingly engaged end faces of the pins 38*a*, 38*b* are flush with the outer circumference of the cylinder 30 so that the cylinder may be turned about its axis by means of the key 34**, as is well known in itself.

A radial end plate 42 attached to the cylinder 30 by two screws 44 rearwardly closes the key slot 32. A flat driver bar 46 conformingly passes through a rectangular opening of the plate 42 so that it turns with the cylinder 30. The driver bar 46 operates a wardrobe turn, omitted from FIGS. 1 to 9, which may be conventional in itself, wardrobe turns of the invention being described below with reference to FIGS. 10 to 13, and being connected to the cylinder locks of FIGS. 1 to 9 as well be described hereinbelow.

A contact carrier 48 of electrically insulating plastic is mounted on the recessed top portion 28 of the casing 26 by means of a pivot pin 50 for angular movement in a plane through the axis of the cylinder 30. The movable contact 52 of an alarm switch is a strip of copper alloy bentinto an approximate L-shape evident from joint consideration of FIGS. 1 to 4. It is mounted on the carrier 48 prior to being bent into its ultimate shape by insertion in a lateral dovetail groove of the carrier, and its free end 54 extends forward from the carrier 48. The rear end of the contact strip 52 is formed with integral terminal prongs 56 for insertion of a conforming tip at the end of a wire or cable.

Figure 2:
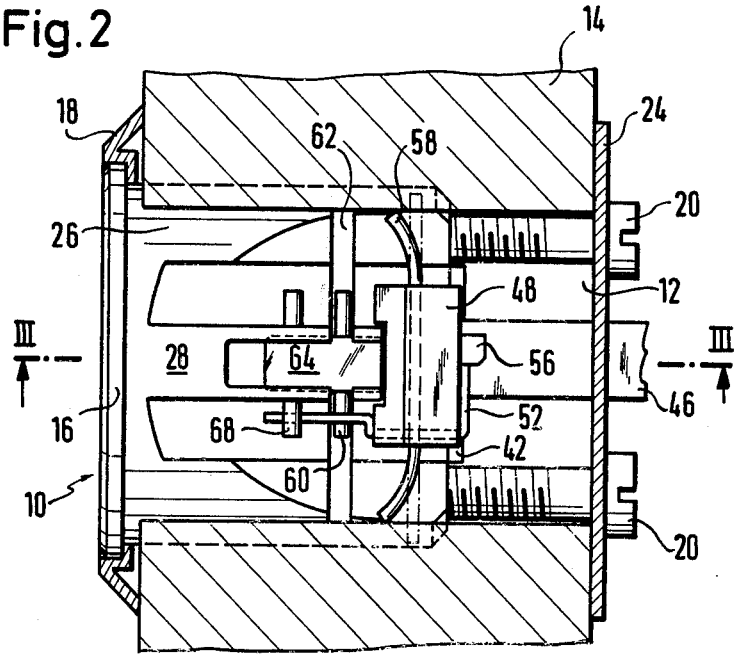
FIG. 2 illustrates the arrangement of FIG. 1 in section on the line II—II.

A wire 58 of spring-temper metallic material passes through the carrier 48 parallel to the axis of the pivot pin 50, and is straight when in the relaxed condition shown in FIG. 2 in broken lines. The corresponding dimension of the bore 12 being smaller than the length of the wire 58, the wire 58 is bent into the shape shown in fully drawn lines by engagement of the free ends of the wire with the wood of the door 14 during axial insertion of the lock 10 into the bore 12 prior to assembly with the plate 24 and the screws 20 and impedes forward movement of the carrier 48 in the direction of the cylinder axis. The stressed spring wire 58 normally biases the carrier 48 counterclockwise, as viewed in FIGS. 1 and 3, into a position of the contact 52 remote from a fixed, metallic contact pin 68 fastened in the casing portion 28 in the path of angular movement of the contact 52 with the carrier 48.

A radial slot 62 in the casing portion 28 intersects the bore of the casing 26 in which the rearmost tumbler pin 38b is slidably received. A contact pin 60 transversely projecting from the pin **38*b* is parallel to the pin 68 and the pivot pin 50. It is normally spacedly aligned with the free end 54 of the movable contact 52 in the direction of tumbler pin movement. A cover 64 is received in a dovetail groove 66 of the casing portion 28 partly to close the slot 62 in a radially outward direction and to back the spring 40 associated with the rearmost tumbler pin 38*b***.

Figure 4:
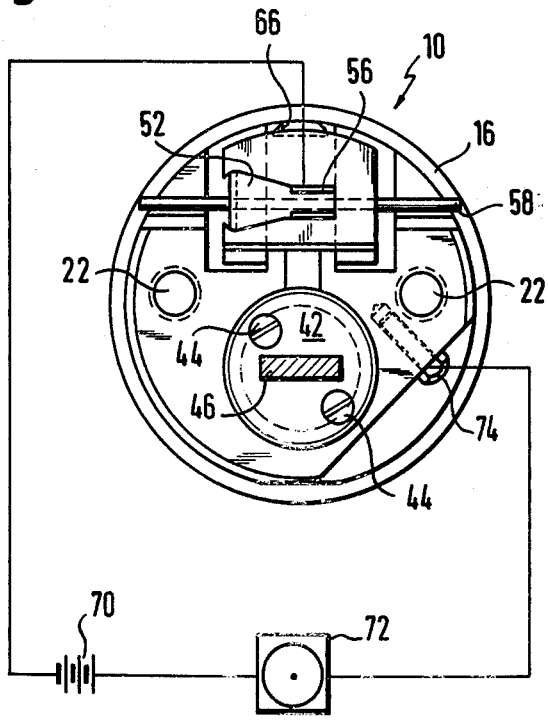
FIG. 4 shows the lock in section on the IV—IV in FIG. 3 and an associated electric circuit by conventional symbols.

The electric alarm circuit opened and closed by the contacts 52, 60, 68 is shown in a conventional manner in FIG. 4 only. A 6-volt battery 70 and a bell 72 are arranged in series between the terminal prongs 56 of the contact 52 and a terminal screw 74 on the casing 26. All illustrated elements of the cylinder lock 10 other than the contact carrier 48 consisting of conductive metal, the contact pins 60 and 68 are permanently connected to the bell 72 by a conductor indicated by a solid line in FIG. 4.

Figure 5:
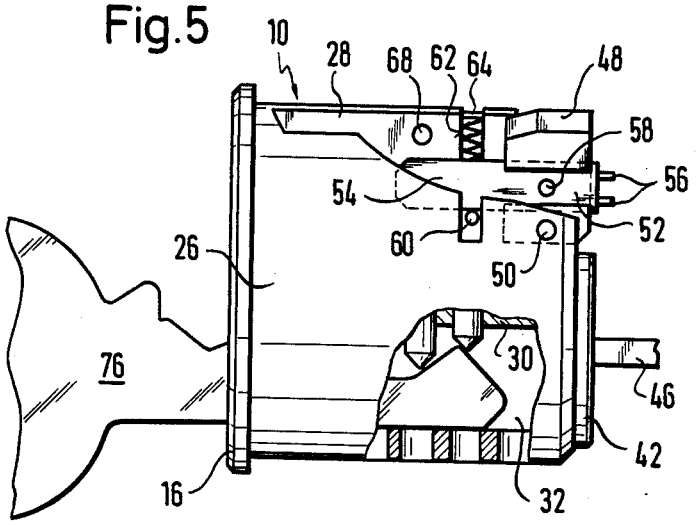
FIG. 5 is a side-elevational, partly sectional view of the same cylinder lock with a partly inserted, wrong key.
Figure 6:
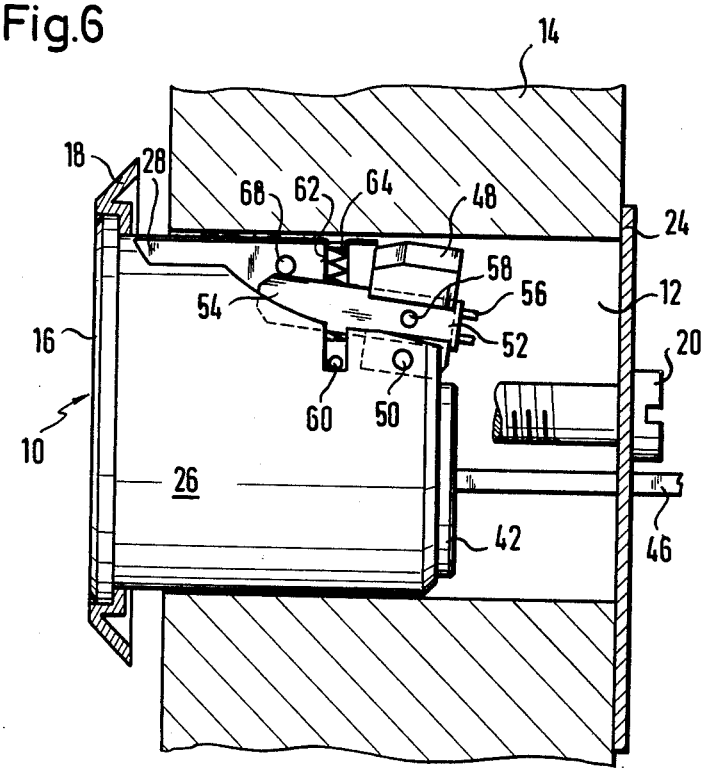
FIG. 6 shows the device of FIG. 1 after attempted removal of the cylinder lock.

The manner in which the bell 72 is energized when an attempt is made to tamper with the lock 10 is evident from FIGS. 5 and 6. FIG. 5 shows an improper key 76 inserted in the key slot 32. An excessively high serration on the key 76 lifts the innermost tumbler pin 38 until the contact pin 60 engages the movable contact 52, thereby energizing the bell 72 and preventing further insertion of the key 76.

When an attempt is made to pull the collar 18 and the lock 10 outward from the door 14 by means of a crowbar or like tool, the spring wire 58 moves the contact carrier 48 clockwise about the pin 50, as is shown in FIG. 6, until the free end 54 of the contact 52 closes the energizing circuit of the bell 72 by engagement with the contact pin 68. Before the condition shown in FIG. 6 can be reached, the screws 20 are broken by the pulling force of the applied crowbar, and the lock requires repairs.

Figure 7:
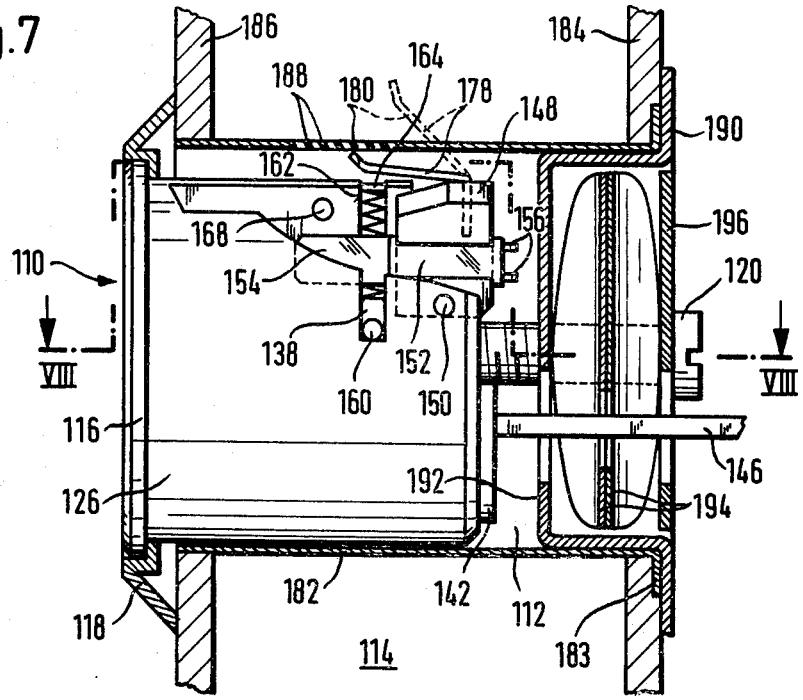
FIG. 7 shows a hollow door equipped with a modified cylinder lock of the invention in a view corresponding to FIG. 1.
Figure 8:
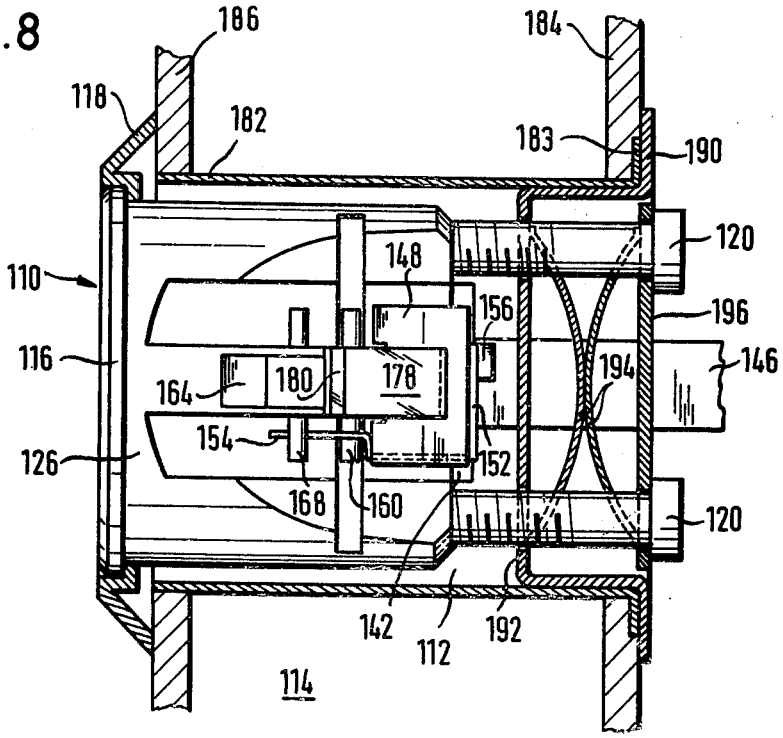
FIGS. 8 and 9 illustrate the arrangement of FIG. 7 in views respectively corresponding to those of FIGS. 2 and 6.
Figure 9:
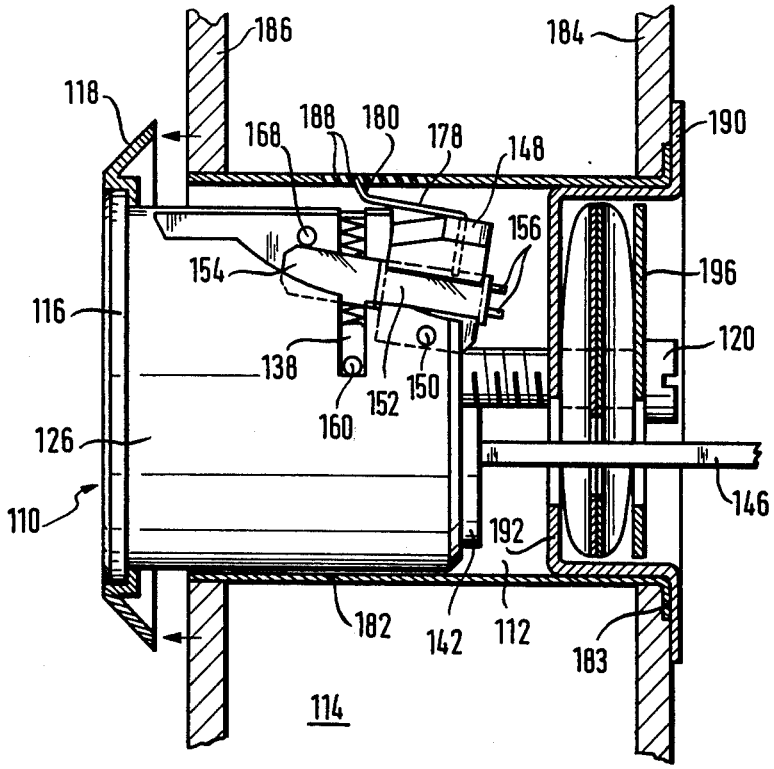

The cylinder lock 110 shown in FIGS. 7 to 9 to be mounted in a passage 112 of a hollow door 114 is closely similar to that described above with reference to FIGS. 1 to 4, but may escape damage under the conditions illustrated in FIG. 6. The elements of the second embodiment of the invention which are close structural and functional counterparts of elements described above have been provided by the same reference numerals, augmented by 100.

The practically identical elements include a flange 116 cooperating with a loose collar 118 at the radial front face of a casing 126 and of a cylinder not itself visible in FIGS. 7 to 9. Tumbler pins 138 may lock the cylinder to the casing 126. An end plate 142 closes the key slot in the cylinder and couples a driver bar 146 to the cylinder. A contact carrier 148 is fastened to the casing 126 by a pivot pin 150 and carries a movable contact 152 having a free end 152 and terminal prongs 156. A contact pin 160 on a tumbler pin 138 moves in a slot 162 of the casing 126 partly closed by a cover 164, and the free end 154 may also close a non-illustrated electric circuit identical with that of FIG. 4 by engagement with a stationary contact pin 164 on the casing 126.

The spring wire 58 described above is replaced by a leaf spring 178 which projects radially and forward from the contact carrier 148 beyond the casing 126. The shape of the spring 178 in the relaxed condition is shown in broken lines in FIG. 7. It is bent into the fully drawn shape during insertion of the lock 110 into the front end of a sleeve 182 which connects the inner or rear panel 184 of the door 114 to the outer or front panel 186 and thus bounds the passage 112. Seven slots in the sleeve 182 bound therebetween ribs 188 transverse to the axis of the cylinder lock 110 for engagement with the free end 180 of the spring 178. When held under flexural stress, as illustrated, by engagement of its free end 180 with the sleeve 182, the spring 178 biases the movable contact 152 away from the stationary contact pin 168 as described above.

Two screws 120 and the driver bar 146, analogous to screws 20 and a bar 46 in FIG. 1, pass freely through the apertured bottom wall 192 of a cup-shaped, flanged mounting member 190 whose main portion is coaxially received in the sleeve 182, the flange of the mounting member 190 abutting against a flange 183 of the sleeve 182 which is recessed flush in the rear panel 184 of the wall 114. The driver bar 146 also passes freely through a pressure plate 196 held parallel to the bottom wall 192 of the mounting member 190 by the heads of the screws 120. The pressure plate 196 is dimensioned for movement inward of the cavity of the mounting member 190 along the screws 120, such movement being opposed by two stacked, cylindrically arcuate leaf springs 194 which are apertured as needed to permit angular movement of the driver bar 146 about the cylinder axis and to pass the screws 120. The springs 194 axially bias the cylinder lock 110 toward the position shown in FIGS. 7 and 8 in which the collar 118 abuts against the front panel 186, but permit limited forward movement of the lock 110 under the pressure of a crowbar or the like without suffering any damage. As is shown in FIG. 9, the free end 180 of the spring 178 is caught during such movement between adjacent ribs 188 and pivots the carrier 148 to energize the alarm bell 72 as described above.

The cylinder locks 10, 110 operate a latch mechanism , such as a wardrobe turn, in the manner illustrated in FIGS. 10 to 13. The turn may be conventional, but preferably provides an additional alarm switch for the circuit shown in FIG. 4.

Figure 10:
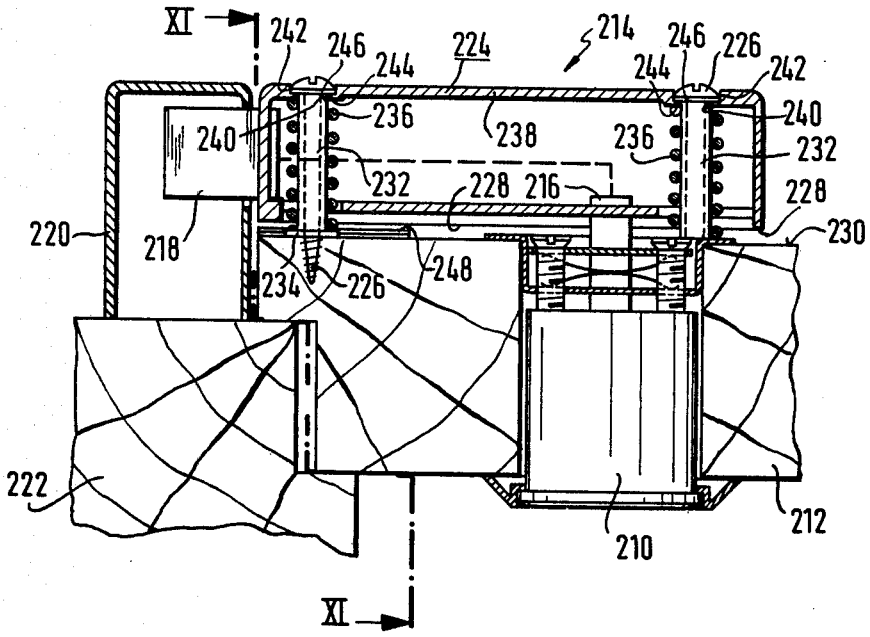
FIG. 10 shows a solid door equipped with the cylinder lock of FIGS. 7 to 9 and a wardrobe turn of the invention in plan section.
Figure 11:
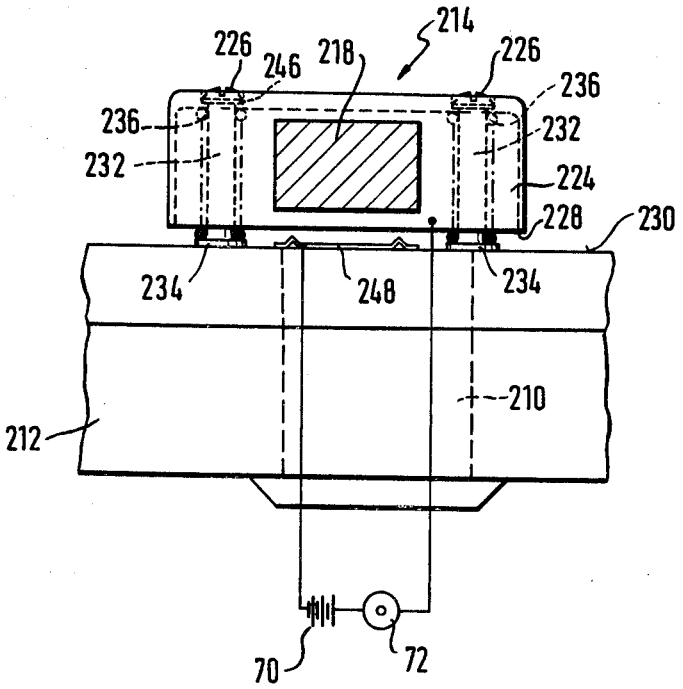
FIG. 11 illustrates the device of FIG. 10 in section on the line XI—XI and an associated electric alarm circuit.
Figure 12:
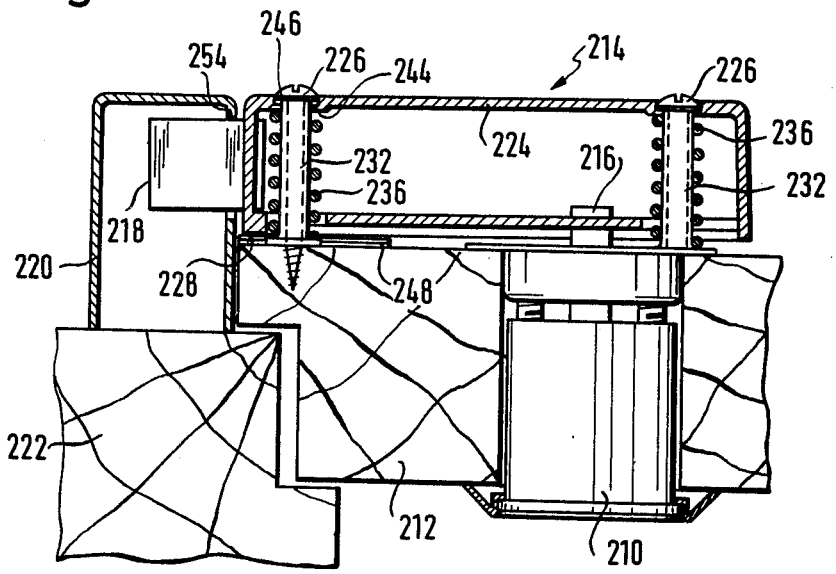
FIG. 12 shows a modification of the arrangement of FIG. 10 in an approximately corresponding view.

The locking arrangement shown in FIGS. 10 to 12 includes a cylinder lock 210 substantially identical with the afore-described lock 110 and set in a bore or passage of a solid door 212 for operating a wardrobe turn 214 by means of its driver bar 216. As is conventional in itself and indicated in FIG. 10 only by a broken line, the internal mechanism of the turn 214 connects the bar 216 to a dead-bolt latch 218 which moves back and forth into and out of an apertured receptacle 220 when a fitting key in the lock 210 turns the bar 216, thereby locking the door 212 to a door frame 222 and unlocking the door.

The shallow, rectangular housing 224 of the turn 214 is attached to the rear or inner face 230 of the door 212 by wood screws 226 passing through aligned bores in the front and rear walls of the housing and long enough to maintain a gap between the front edge 228 of the housing 224 and the door face 230. A tubular spacer 232 coaxially envelopes each screw 226 and has a fixed flange 234 abutting against the door face 230. A helical compression spring 236 coiled about each spacer 232 is stressed between the rear wall 238 of the housing 224 and the flange 234. The bores 240 in the rear wall 238 which receive the shafts of the wood screws 226 are wide enough to pass the spacers 232, but smaller than the cross section of the springs 236.

The heads of the wood screws 226 are partly recessed in the enlarged orifices 242 of the bores 240, and a washer 246, integral with the spacer 232, is interposed between each screw head and the annular bottom 244 of the associated orifice 242. The washer 246 is formed by upsetting the spacer 232 during assembly of the device. A sheet metal contact 248 is attached to the inner door face 230 by non-illustrated nails and electrically insulated from the housing 224 by the wood of the door 212. Conductors, shown only in FIG. 11, connect the contact 248 to the battery 70 and the housing 224 to the bell 72.

When an attempt is made to force the door 212 open, the dead-bolt latch 218 secures the associated side of the turn 214 to the receptacle 220 and the door frame 222 so as to pivot the housing 224 on the screws 226 against the restraint of the springs 236, and to engage the contact 248 with the edge 228 of the housing, thereby energizing the bell 72.

Figure 13:
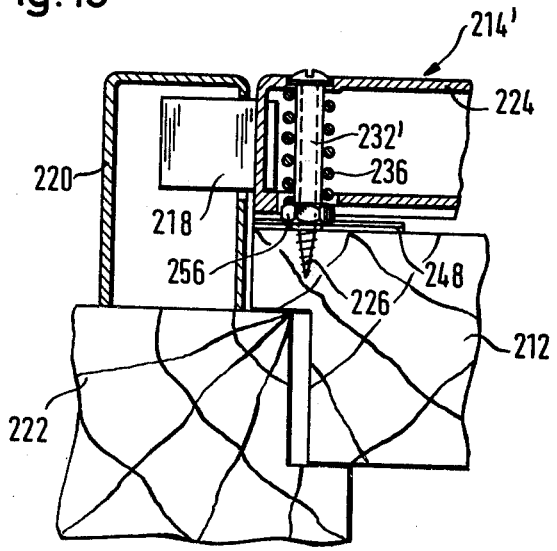
FIG. 13 is a partial view of a further modified version of the apparatus of FIG. 12.

The modified wardrobe turn 214' shown in FIG. 13 differs from that described with reference to FIGS. 10 to 12 only by a spacer 232' whose lower end is externally threaded to accomodate a nut 256 replacing the fixed flange 234 and providing an adjustable abutment for the spring 236.

The alarm circuit, as shown in FIGS. 4 and 11, includes only a minimal number of basic elements. It will usually be advantageous to operate the bell 72 through a relay in circuit with the switches constituted by stationary and movable contacts on the locking arrangement and provided with a holding circuit which keeps the bell energized after the switches have been opened until the holding circuit is opened manually or by a timing device as is conventional in burglar alarms. The bell 72, of course, may be replaced by any other generator of a perceptible signal, such as a siren, a flashing light, a pilot lamp on an indicator board of a police station, or other devices known in themselves. A bell or like local source of a perceptible signal is sufficient for discouraging many would-be burglars.

Other variations of the illustrated locking arrangements will readily suggest themselves to those skilled in the art. It should be understood, therefore, that the foregoing disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. A locking arrangement comprising:

a. a casing element defining an axis of rotation;

b. a cylinder element mounted in said casing element for angular movement about said axis and formed with a key slot extending inward of one axially terminal face of said cylinder element;

c. tumbler means in said elements for normally preventing said angular movement and responsive to a key inserted in said key slot for permitting said movement;

d. a spring member having a portion radially projecting from said casing element, said portion being axially movable relative to said casing element, said spring member being stressed resiliently when said portion is moved in one axial direction;

e. first and second contact means mounted on said casing element in electrically insulated relationship; and f. motion transmitting means interposed between said spring member and said first contact means for biasing said first contact means toward a circuit opening position remote from said second contact means in response to said stressing of said spring member, and for conductively engaging said first and second contact means in response to movement of said portion in the other axial direction.

2. An arrangement as set forth in claim 1, further comprising a driver member mounted on said cylinder element for joint angular movement and projecting from the other axially terminal face of said cylinder element, and turn means engaged by said driver member, said turn means including a housing and a latch member mounted on said housing for reciprocating movement in response to said joint angular movement, said motion transmitting means including a contact carrier movably mounted on said casing element and carrying said first contact means.

3. An arrangement as set forth in claim 2, wherein said spring member is elongated, said portion thereof is a free longitudinal end portion, and said spring member is flexed when said end portion moves in said one axial direction.

4. An arrangement as set forth in claim 3, further comprising pivot means securing said contact carrier to said casing for angular movement in a plane substantially parallel to said axis.

5. An arrangement as set forth in claim 2, further comprising first fastening means for fastening said casing element in an aperture of a plate-shaped body in a position in which said portion of said spring member engages said body in said aperture, second fastening means for mounting said turn means on said body for pivotal movement relative to said body, third contact means mounted on said latch means for movement therewith, fourth contact means, and third fastening means for fastening said fourth contact means on said body in a position for engagement by said third contact means during said pivotal movement of said turn means.

6. An arrangement as set forth in claim 5, further comprising abutment means engageable with said turn means for limiting said pivotal movement, and yieldably resilient means biasing said turn means toward engagement with said abutment means.

7. An arrangement as set forth in claim 1, wherein said tumbler means include a pair of tumbler pins radially aligned in respective bores of said elements in a predetermined angular relationship of said elements for joint, radial movement inward and outward of said key slot, and third contact means operatively connected to one of said tumbler pins for conductively engaging said one contact means in response to radially outward movement of said one tumbler pin.

8. An arrangement as set forth in claim 1, further comprising fastening means for fastening said casing element in an aperture of a plate-shaped body in a position in which said portion of said spring member frictionally engages said body in said aperture, said fastening means including yieldably resilient means opposing axial movement of said casing element in said aperture.

9. An arrangement as set forth in claim 8, wherein said fastening means include a mounting member, means for fixedly fastening said mounting member to said body, a pressure plate fixedly fastened to said casing element, and a spring axially interposed between said mounting member and said pressure plate.

10. An arrangement as set forth in claim 9, wherein said mounting member is approximately cup-shaped and defines a cavity receiving said pressure plate and said spring.

11. An arrangement as set forth in claim 1, further comprising a sleeve member formed with a passage therethrough dimensioned to receive said casing element therein, and engaging means on said sleeve member in said passage for engaging said portion of said spring member, and for impeding axial movement of the engaged portion when said casing element is received in said passage.

* * * * *